US006679409B2

(12) United States Patent
Petterson

(10) Patent No.: US 6,679,409 B2
(45) Date of Patent: Jan. 20, 2004

(54) DISPENSER FOR ROLLS OF WEB-SHAPED MATERIAL

(75) Inventor: Tor Petterson, deceased, late of Rancho Palos Verdes, CA (US), by Grace Petterson, legal representative

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/930,209

(22) Filed: Aug. 16, 2001

(65) Prior Publication Data

US 2002/0121537 A1 Sep. 5, 2002

Related U.S. Application Data

(63) Continuation of application No. PCT/SE99/00306, filed on Mar. 3, 1999.

(51) Int. Cl.[7] ..... B26F 3/02; B65L 19/00

(52) U.S. Cl. ..... 225/34; 225/42; 225/46; 83/650; 242/560; 242/560.1; 220/501; 221/32; 221/98; 312/34.22

(58) Field of Search ..... 83/650, 946; 225/34, 225/42, 46, 47, 53, 77, 90; 242/560.3, 559.3, 559.4, 560, 599, 560.1; 220/501, 507; 221/32, 97, 98, 100, 99, 101, 103, 106, 108, 109, 45, 33; 312/34.2, 34.22, 34.23, 34.4

(56) References Cited

U.S. PATENT DOCUMENTS

| | | | | | |
|---|---|---|---|---|---|
| 534,891 | A | * | 2/1895 | Knox et al. | 217/44 |
| 2,839,346 | A | | 6/1958 | Lawalin | |
| 3,374,042 | A | * | 3/1968 | Smith | 242/560.3 |
| 3,580,651 | A | * | 5/1971 | Gauper | 312/34.22 |
| 3,700,181 | A | * | 10/1972 | Diring et al. | 242/560.3 |
| 3,770,222 | A | * | 11/1973 | Jespersen | 242/560.3 |
| 3,865,295 | A | | 2/1975 | Okamura | |
| 4,034,924 | A | * | 7/1977 | Carlisle | 242/560.3 |
| 4,383,657 | A | | 5/1983 | Suh | |
| 4,410,221 | A | | 10/1983 | Vallis et al. | |
| 4,671,466 | A | | 6/1987 | Jespersen et al. | |
| 5,000,393 | A | * | 3/1991 | Madsen | 221/297 |
| 5,765,719 | A | * | 6/1998 | Upham et al. | 221/196 |

FOREIGN PATENT DOCUMENTS

| | | |
|---|---|---|
| CH | 404124 | 12/1965 |
| DE | 2822091 | 5/1979 |
| EP | 0034121 | 8/1981 |
| FR | 2737199 | 1/1997 |
| GB | 2193703 | 2/1988 |
| SE | 9800651-3 | 9/1999 |

* cited by examiner

*Primary Examiner*—Boyer D. Ashley
(74) *Attorney, Agent, or Firm*—Burns, Doane, Swecker & Mathis, L.L.P.

(57) ABSTRACT

Dispenser for rolls of a web-shaped material, such as paper, said dispenser having space for at least two rolls, at which one space is located adjacent the outlet opening (14) and is intended for a first roll in a use position and the second space is located above the first space and is intended for a roll in standby position. A lock (24, 25;27) is intended to keep the second roll in standby position. The disk plate is spring-loaded (23) and cooperates with the lock such that when a roll is located in place in the disk plate the lock (24, 25;27) prevents the standby roll from falling down.

12 Claims, 4 Drawing Sheets

DISPENSER FOR ROLLS OF WEB-SHAPED MATERIAL

This application is a continuation of International Application No. PCT/SE99/00306, filed on Mar. 3, 1999, which International Application was published by the International Bureau in English on Sep. 8, 2000.

TECHNICAL FIELD

The present invention refers to a dispenser for rolls of web-shaped material, such as paper and nonwoven, said dispenser comprising a housing having at its bottom part an outlet opening for the web-shaped material and said housing having space for at least two rolls arranged substantially horizontally. A first part of the space is located adjacent the outlet opening and is intended for a first roll in a use position and a second part of the space is a locking device intended to keep the second roll in standby position said first part is provided with holding means for keeping the first roll in use position, said holding means is spring-loaded and cooperates with the locking means in such a way that when a roll is located in place in the first space the locking means prevents the standby roll from falling down, but when the roll is removed from the first space the locking means will be released and permit the standby roll to fall down to use position in the first space.

BACKGROUND OF THE INVENTION

Dispensers of this kind, e g for toilet paper rolls, are intended for two or more rolls, at which one roll is in use position and the other roll(-s) is/are in standby position and is/are transferred to use position when the first roll is used up and its empty core has been removed from the dispenser.

A plurality of dispensers of this kind are previously known. Thus U.S. Pat. No. 3,865,295 discloses a toilet paper dispenser in which the rolls are each threaded on a wooden rod which runs in the dispenser wall and can be suspended in a pendulum mechanism. When changing rolls the user pushes a bar on the pendulum mechanism backwards so that on one hand the core and wooden rod of the lower roll are released and on the other hand the roll above can fall down into use position for dispensing paper. This dispenser thus requires special wooden rods for the suspension of the rolls in the dispenser.

In U.S. Pat. No. 4,383,657 there is disclosed a dispenser for two paper rolls, in which the lower roll slides freely against the bottom of the dispenser housing and a sloping rear edge thereof so that it is brought forwards to dispensing position towards a dispenser opening provided with a tearing edge. The upper roll is prevented from falling down by the upper part of a lever arm. When changing rolls the user presses on the lower part of the lever arm, which is designed as a pressure plate. The empty core is then pushed out through an opposed opening and the stop lug on the top of the lever arm is put aside so that the upper roll can fall down.

In EP-A-0,034,121 there is shown a paper dispenser for two or more rolls arranged on top of each other and where the roll which is located in use position adjacent the dispenser opening rest on a tilting plate. When the roll is used up the tilting plate can be brought to be tilted upwards by pushing a portion projecting from the dispenser opening, at which the empty core is pushed out through the dispenser opening and a locking device which keeps another roll in standby position is brought aside, at which the standby roll can fall down to use position.

CH 404 124 discloses a dispenser for two paper rolls, one of which is kept in use position between a pair of lever arms, which are springloaded towards each other so that the paper roll is squeezed therebetween. The other roll, the standby roll, is kept in place by a locking mechanism,, which is activated as long as the lever arms are pressed apart by a roll. When the empty roll is removed the lever arms will swing away from each other and release the lock mechanism, so that the standby roll will fall down into use position.

OBJECT OF THE INVENTION

The object of the present invention is to provide a dispenser of the above mentioned kind in which the rolls are kept in place without the need of being threaded on special rods, which is easy to use without special instructions and where the standby roll automatically will fall down into use position when the core from a used up roll is removed from the dispenser. The roll should further be kept in a correct use position in the dispenser without exerting a squeezing effect. This has according to the invention been obtained by the fact that the holding means for holding the roll in use position comprises a vertically arranged disk plate having a flange intended to grip around one end of the roll and keep it in use position.

Further features of the invention are disclosed in the dependant claims and the description.

DESCRIPTION OF DRAWINGS

The invention will below be closer described with reference to a couple of embodiments shown in the accompanying drawings.

DESCRIPTION OF EMBODIMENTS

Figure 1:
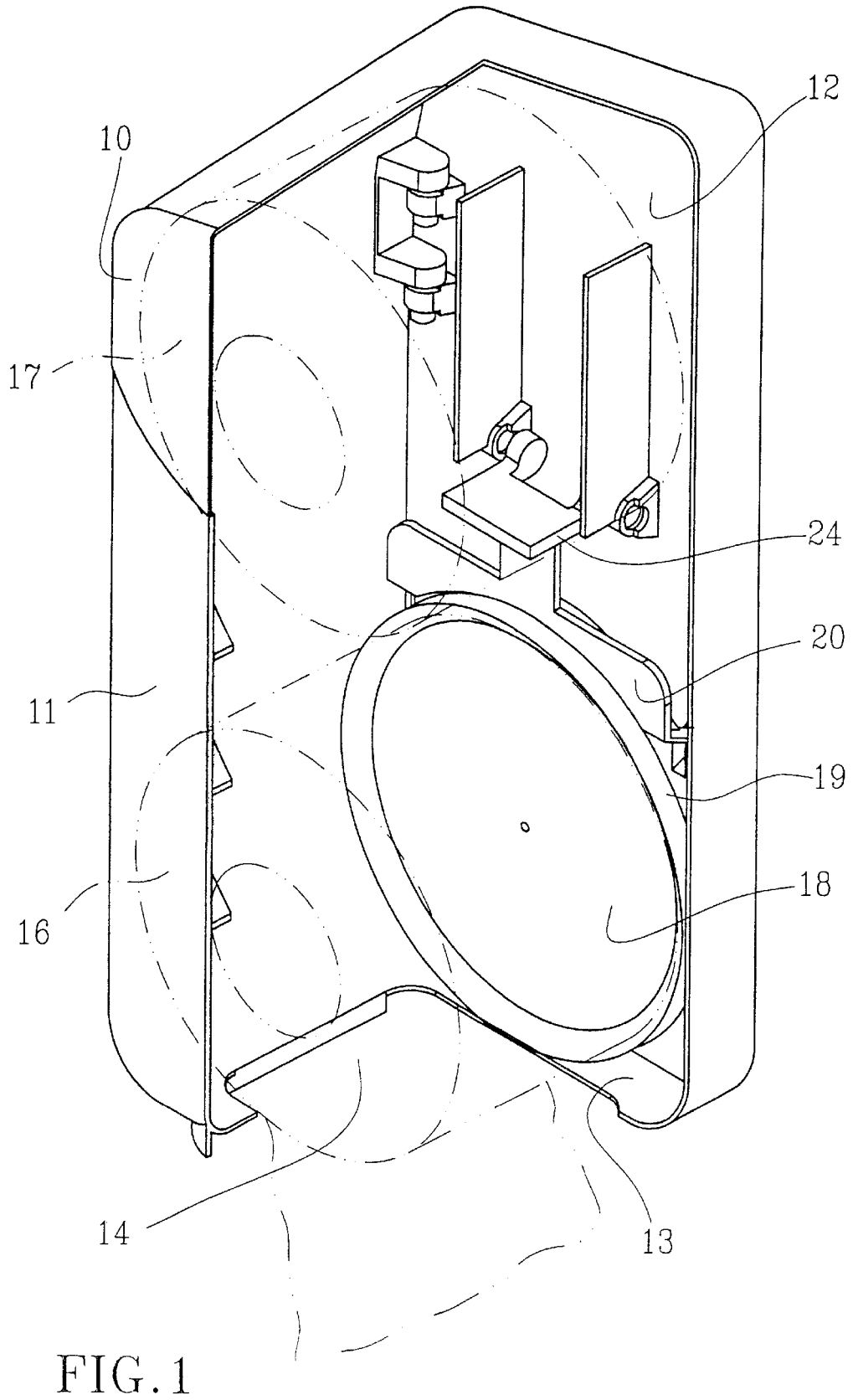
FIG. 1 is a perspective view of a dispenser with a part of the housing removed.

The invention refers to a dispenser for rolls of a web-shaped material, which means all types of flexible web-shaped materials, e g plastic- or aluminum foil, nonwoven and paper. It is below mainly referred to paper although the invention is not limited to dispensers for paper. The paper can be in the form of a continuous web, at which the dispenser is provided with tearing teeth or another sharp tearing edge for cutting a certain length of the paper. The paper web can also be provided with perforations at a certain interval, in order to allow a certain length of the paper to be cut off from the roll.

At first hand such rolls are concerned where the paper is rolled up on a stiff core, but it is also possible to let the innermost windings of the paper web form a stiffened core in the roll, e g by being joined together by means of water spraying gluing or the like.

The dispenser comprises a housing which comprises and upper cover 10 and a lower cover 11 and a back plate 12, which is designed as a bracket for hanging the dispenser on a wall or the like. The upper cover 10 is releasably or pivotably connected to the lower cover 11. The paper can by that be filled in the dispenser from above. The housing is further provided with a bottom 13, which either can be integrated with or separated from the lower cover 11 or the back plate 12. The bottom 13 is provided with a dispensing opening 14, which can have tearing teeth 15 (FIG. 3) on one or more of its edges, against which a desired length of the paper web can be torn off. The tearing means may of course be designed in many different ways. In the case the paper web is perforated the tearing means can be replaced by different types of the braking- or friction means, which provide a sufficient friction against the paper web in order to make this tear along the perforation at the dispensing.

The dispenser has room for two rolls 16 and 17 arranged substantially axially horizontally, at which the first space is located adjacent the dispensing opening 14 and is intended for the roll 16 which is located in a position ready for use. The second space is located straightly above the first space and is intended for a roll 17 which is located in a standby position. In the first space there is arranged a substantially vertically suspended disk plate 18 which is provided with a flange 19 intended to grip around one edge of the roll 16 and in this way keep this in use position. The disk plate 18 is rotatably mounted to a holder 20, which is tiltably mounted on the back plate 12 to essentially horizontal axle elements 21. The holder 20 has an elongated lower portions 22 which contacts a plate spring 23 which is attached to the back plate 12. The holder 20 and the disk plate rotatably connected thereto can against the action of the plate spring 23 be tilted around the axle 21. In the embodiment shown in FIG. 3 the holder 20 is provided with an operating tongue 22*a* which projects through the dispensing opening in order to facilitate the removal of the empty core.

Figure 2:
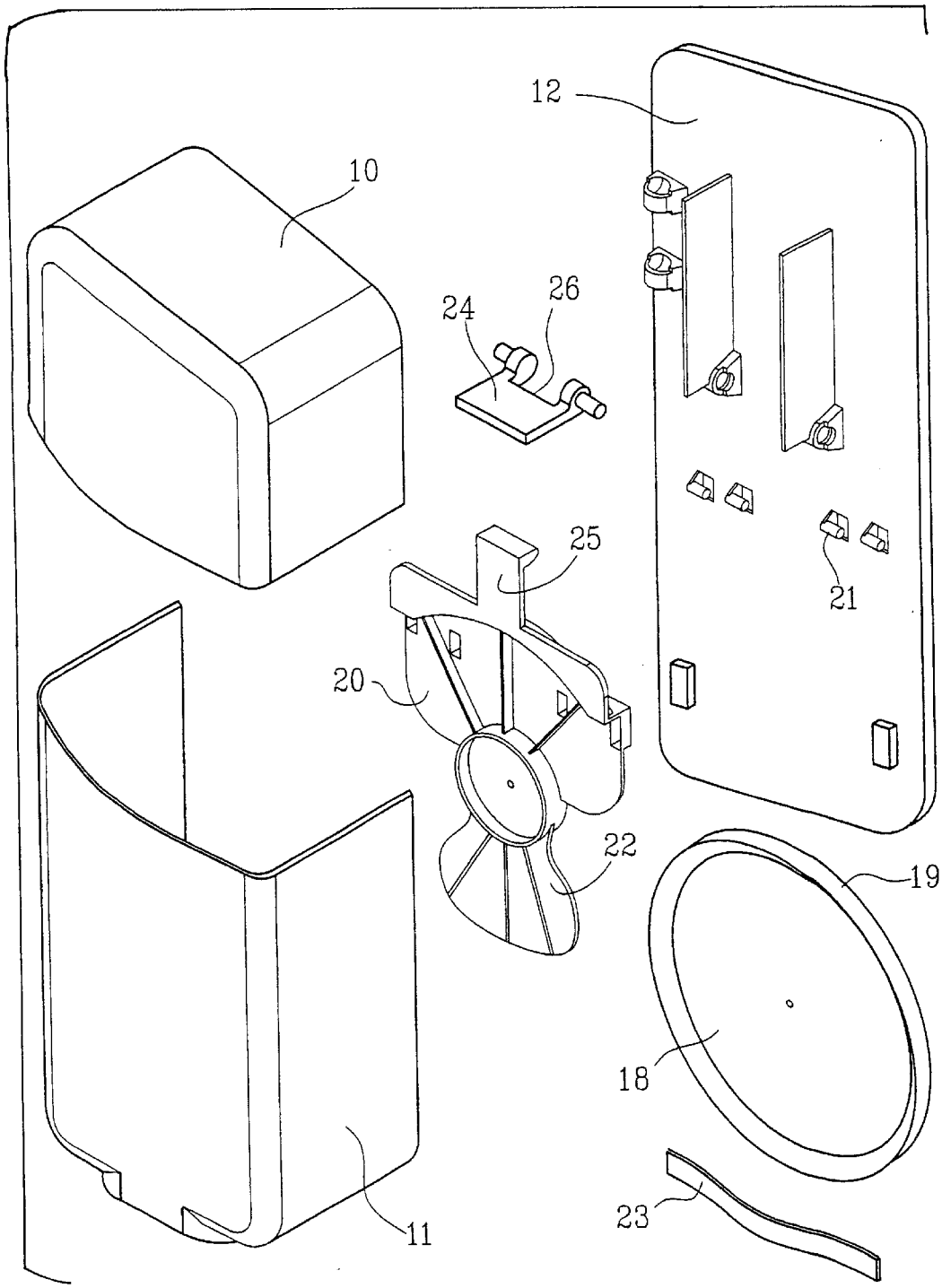
FIG. 2 shows in perspective an exploded view of the dispenser according to FIG. 1.

According to the embodiment shown in FIGS. 1 and 2 there is arranged a locking means in the form of a spring-loaded flap 24 between the upper and lower spaces of the dispenser, said flap will rest against an upward directed support means 25 on the holder in a position where a pressure (from a paper roll or an empty core) acts on the disk plate 18 and by that on the lower spring-loaded portions of the holder 20. The paper roll 17 which is located in standby position will rest against the flap 24 and be kept in place as long as this is supported by the support means 25. If however the pressure on the disk plate is interrupted the spring 23 will force the holder 20 and the disk plate 18 attached therein to tilt around the axle 21, so that its lower part is swung out from the back plate 12 and the upper portion is swung in towards the back plate 12. The support means 25 is then brought into a recess 26 behind the flap 24, which by the weight from the standby roll 17 folds down at which the roll automatically falls down to use position, where it rests in the disk plate 18. When the roll lands up in place in the disk plate 18 it will force this and the holder 20 to tilt back against the action of the spring 23, at which the spring-loaded flap 24 returns to its position where it can act as locking means for a new roll that is placed in the upper standby space of the dispenser.

Brake- or friction means in the form of ribs or the like may be arranged on the inside of the lower and/or upper cover 10 in order to brake the movement of the roll on its way from the standby position to use position and prevent it from falling down directly with its whole weight.

Figure 3:
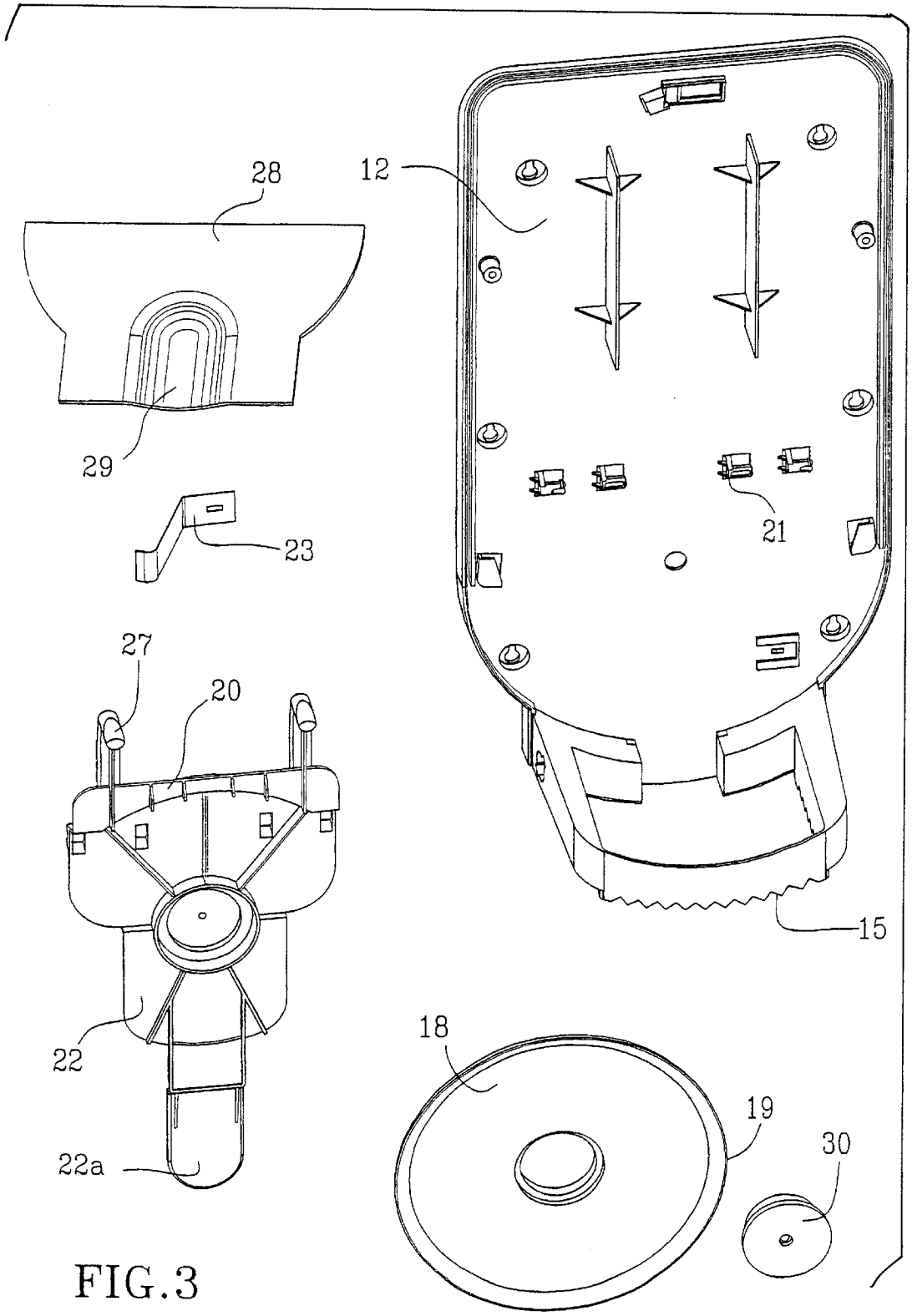
FIG. 3 shows in perspective an exploded view of a modified embodiment of the dispenser.
Figure 4:
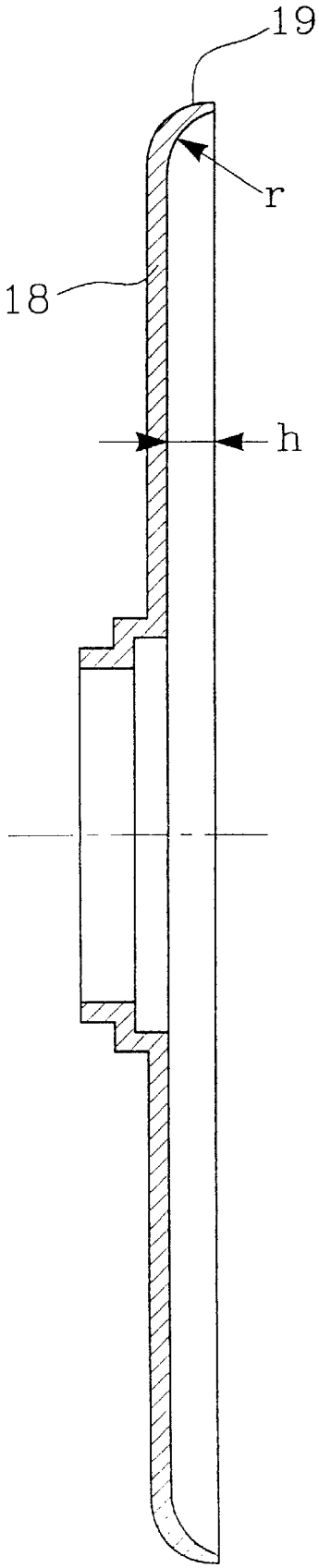
FIG. 4 is a cross section through the disk plate included in the dispenser.

According to the embodiment shown in FIG. 3 the locking means which keeps the standby roll in place consists of a pair of supporting pins 27, which form an integrated part with the holder 20. The standby roll will be supported by these supporting pins 27 as long as a roll or empty core is located in the disk plate 18, but as soon as the empty core is removed the disk plate and the holder 20 actuated thereby will, in a corresponding way as described above, tilt around the axle 21, at which the supporting pins 27 will be brought in the direction towards the back plate 12 and out of engagement with the standby roll, which then falls down to use position in the disk plate 18.

The design of the spring 23 differs also from what is shown in FIGS. 1 and 2, however the function is the same. The disk plate 18 is attached to the holder 20 by means of a threaded cap 30. In FIG. 3 there is also shown a plate 28 intended to be fastened on the inside of the lower cover 11 just opposite the disk plate 18. The plate 28 has at its lower portion a groove-shaped recess 29, in which the empty core or an almost used up roll with only a few paper windings left will end up. By that the removal of the core is facilitated. On the other hand the removal of a roll where only so much paper is left that the roll has not yet slid into the recess is obstructed. The plate 28, which for example is of rustless steel, also reduces the friction at the rotation of the roll when unwinding the paper.

The design of the disk plate 18 is of a certain importance and thus the height and radius of curvature of the flange 19 should be such dimensioned that on one hand a safe holding of the roll is achieved and on the other hand permitting the standby roll to automatically fall down into place in the disk plate. The height of the flange 19 should be between 2–20 mm, preferably 5–15 mm and the radius of curvature should be between 2–20 mm, preferably 5–15 mm.

The dispenser according to the invention has a number of advantages such as:

- it has a great capacity, i e it can store much paper, which means a less frequent filling,
- it has a safe and simple mechanism with few parts,
- it is simple to use and load with more paper,
- it is possible to remove a not completely empty almost used up roll with only a few windings left from use position, in order to enable replacement for a new roll, at the same time as it is not possible to remove a roll containing a greater number of windings.

The invention is of course not delimited to the shown embodiments but a plurality of modifications are possible within the scope of the claims. Thus it is possible to arrange two opposite disk plates 18 between which the roll 16 is placed, at which the second disk plate is rotatably mounted in the lower cover 11. The disk plate(-s) can also be fixed, i e non-rotatable, at which the roll rotates against the inside of the disk(-s). The locking means which keeps the standby roll in place may also be designed in many different ways. Another possibility is to design the covers 10,11 exchangeable and with different depths in order to be adapted to rolls of different widths. The covers 10,11 may also be provided with transparent sighting notches to make it possible to see from the outside whether a standby roll is in place and how much is left of the roll in use position. The covers may of course wholly be of a transparent material, at which the sighting notches are superfluous.

What is claimed is:

1. A dispenser for rolls of a web-shaped material, said dispenser comprising a housing having at a bottom part an outlet opening for the web-shaped material and said housing having a space for at least two of the rolls of web-shaped material, each of the rolls arranged substantially horizontally, a first part of the space is located adjacent the outlet opening and is adapted for a first roll in a use position and a second part of the space is located above the first part of the space and is adapted for a second roll in a standby position, a lock is adapted to keep the second roll in the standby position, said first part of the space is provided with a holder for keeping the first roll in the use position, said holder is spring-loaded and cooperates with the lock in such a way that when the first roll is located in the first part of the space the lock prevents the second roll from falling down, but when the first roll is removed from the first part of the space the lock will be released and permit the second roll to fall down to the use position in the first part of the space, the holder comprises a vertically arranged substantially planar disk plate and a flange extending from the disk plate, the flange extends out of the plane of the planar disk plate and is adapted to extend around an outer edge of one end of the first roll so as to hold the first roll in the use position.

2. The dispenser as claimed in claim 1, wherein the disk plate is pivotable in the housing around one or more essentially horizontal axle elements substantially perpendicular to the axial direction of the first roll and is spring loaded in such a way that in an unloaded position, when there is no roll in place in the use position, the disk plate will take a position so that the lock is inactive, but when a roll comes into place in the use position, the disk plate will against the action of the spring be rotated to a position where the lock is activated and can keep a second roll in the second part of the space.

3. The dispenser as claimed in claim 1, wherein the flange of the disk plate has a height between 2 and 20 mm and a radius of curvature of the flange is between 2 and 20 mm.

4. The dispenser as claimed in claim 1, wherein the disk plate is mounted in a holder which is rotatably mounted in the housing around said substantially horizontal axle elements and the holder is provided with said lock.

5. The dispenser as claimed in claim 4, wherein the disk plate is pivotably mounted in the holder.

6. The dispenser as claimed in claim 1, wherein in the housing just opposite the disk plate there is arranged a smooth friction reducing member provided with a recess in which an empty core from a used up roll or an almost used up roll with only a few winding left can slide into, at which the removal of the empty or almost used up roll is facilitated.

7. The dispenser as claimed in claim 1, wherein the flange of the disk plate has a height between 5 and 15 mm.

8. The dispenser as claimed in claim 1, wherein a radius of curvature of the flange is between 5 and 15 mm.

9. A dispenser for rolls of web-shaped material, the dispenser comprising:

a housing, the housing having an outlet at a bottom portion thereof;

a space within the housing, a first part of the space being located adjacent the outlet and a second part of the space being located above the first part of the space;

a disk plate located in the first space for holding a roll of web-shaped material;

a disk plate holder for pivotally mounting the disk plate to the housing;

the disk plate including a substantially planar disk and flange extending from the disk out of the plane of the planar disk, said flange adapted to extend around an end of the roll in the first part of the space so as to hold the roll in a use position;

a spring biasing the disk plate so that when there is no roll in the first part of the space, the disk plate is biased into a first position and when a roll is in the first part of the space, the disk plate is urged against the spring into a second position;

a pivotable locking element arranged adjacent the disk plate holder, said locking element adapted to support a second roll in the second part of the space when the locking element is in a first position and is further adapted to allow the second roll to move into the first part of the space when the locking element is in a second position;

wherein the disk plate holder and the locking element cooperate such that when the disk plate is in the first position, the locking element is free to move into the second position by the weight of the second roll and when the disk plate is in the second position, the locking element is held in the first position.

10. The dispenser as claimed in claim 9, wherein the disk plate is substantially circular in shape and is adapted to support an entirety of the end of the roll in the first part of the space.

11. The dispenser as claimed in claim 10, wherein the flange completely encircles the end of the roll in the first part of the space.

12. The dispenser as claimed in claim 9, wherein when the disk plate is in the first position, the disk plate can receive a roll from the second part of the space.

* * * * *